US006185395B1

(12) United States Patent
Lee

(10) Patent No.: US 6,185,395 B1
(45) Date of Patent: Feb. 6, 2001

(54) PHOTORECEPTOR WEB INSTALLING/ REMOVING APPARATUS FOR A PRINTER

(75) Inventor: Min-soo Lee, Ueiwang (KR)

(73) Assignee: Samsung Electronics Co., Ltd., Kyungki-Do (KR)

( * ) Notice: Under 35 U.S.C. 154(b), the term of this patent shall be extended for 0 days.

(21) Appl. No.: 09/473,992

(22) Filed: Dec. 29, 1999

(30) Foreign Application Priority Data

Jan. 18, 1999 (KR) ..... 99-1249

(51) Int. Cl.[7] ..... G03G 15/02
(52) U.S. Cl. ..... 399/116; 399/165
(58) Field of Search ..... 399/116, 117, 399/162, 164, 165

(56) References Cited

U.S. PATENT DOCUMENTS 3,888,577 * 6/1975 Meyer ..... 399/116
4,766,455 * 8/1988 Carter ..... 399/116
5,400,121 * 3/1995 Foote ..... 399/116
5,417,322 * 5/1995 Jeran et al. ..... 399/116 X
5,669,043 * 9/1997 Nishino et al. ..... 399/116
5,708,924 * 1/1998 Shogren et al. ..... 399/116
5,978,625 * 11/1999 Park ..... 399/116
6,014,535 * 1/2000 Zenk et al. ..... 399/116

* cited by examiner

*Primary Examiner*—Fred L. Braun
(74) *Attorney, Agent, or Firm*—Sughrue, Mion, Zinn, Macpeak & Seas, PLLC

(57) ABSTRACT

A photoreceptor web installation/removing apparatus of a printer includes a roller unit installed in a main body of the printer and having a frame for supporting both ends of a support roller that supports a photoreceptor web. The installation/removing apparatus further includes a pair of mobile brackets, installed on the frame, for supporting both ends of a tension roller. A belt installation cartridge accommodates a new photoreceptor web to be installed on the roller unit and is capable of being inserted in the main body of the printer to encompass the roller unit. A belt removing cartridge removes the photoreceptor web installed on the roller unit and is capable of being inserted in the main body of the printer. A locking/releasing device selectively locks to and releases from the roller unit, the belt installation cartridge or the belt removing cartridge when inserted in the main body of the printer. A recognition device recognizes the type of belt cartridge inserted in the main body of the printer.

14 Claims, 11 Drawing Sheets

PHOTORECEPTOR WEB INSTALLING/ REMOVING APPARATUS FOR A PRINTER

BACKGROUND OF THE INVENTION

1. Field of the Invention

The present invention relates to a photoreceptor web installing/removing apparatus for a printer, having an improved structure so that a photoreceptor web can be easily installed on a roller unit and removed therefrom.

2. Description of the Related Art

In general, as shown in FIG. 1, a printer or copier includes a roller unit 10 installed in a main body 1 of the printer and a photoreceptor web 20 installed so as to circulate around the roller unit 10. The roller unit 10 includes a frame 13 by which a plurality of support rollers 11, for supporting the photoreceptor web 20, are supported. A mobile bracket 14 is movably installed on the frame 13 by which a bracket tension roller 12 for adjusting the tension of the photoreceptor web 20 is supported. The photoreceptor web 20 circulates on a continuous path while being supported by the rollers 11 and 12. An image formed on a surface of the photoreceptor web 20 is developed by a predetermined development device (not shown).

The photoreceptor web 20 is flexible. Therefore, to easily install the photoreceptor web 20 on the roller unit 10 or remove it therefrom, a belt installation cartridge 30 and a belt removing cartridge 40 (see FIG. 2) are used. The belt installation cartridge 30, accommodating the photoreceptor web 20 inside, is inserted in the main body 1 of the printer so as to encompass the roller unit 10 and install the photoreceptor web 20 on the roller unit 10. After the photoreceptor web 20 is installed, the belt installation cartridge 30 is pulled back. Also, to replace the photoreceptor web 20, the belt removing cartridge 40 is inserted in the main body 1 of the printer so as to encompass the roller unit 10. Next, the photoreceptor web 20 is clamped by a predetermined clamping device (not shown) provided on the belt removing cartridge 40. Then, as the belt removing cartridge 40 is removed from the main body 1 of the printer, the photoreceptor web 20 is removed from the roller unit 10.

However, the belt cartridges 30 and 40 may not be completely inserted in the main body 1, and even when they are completely inserted, they may not be firmly secured, or may be inserted at an incline. In any of these cases, the photoreceptor web 20 may be incorrectly installed on the roller unit 10, or the photoreceptor web 20 may not be smoothly removed. Further, it is inconvenient for a user to carefully check whether the belt cartridge is completed and firmly inserted.

SUMMARY OF THE INVENTION

To solve the above problems, it is an object of the present invention to provide an apparatus, for installing/removing a photoreceptor web of a printer, having an improved structure so that the belt cartridge is fixedly installed in the main body of the printer, wherein a belt cartridge for installing or removing the photoreceptor web is completely inserted in a main body of the printer.

Accordingly, to achieve the above and other objects, there is provided a photoreceptor web installation/removing apparatus, for a printer, which comprises a roller unit installed in a main body of the printer and having a frame for supporting both ends of a support roller that supports a photoreceptor web. Additionally, a pair of mobile brackets, movably installed on the frame, supports both ends of a tension roller. A belt installation cartridge accommodates a new photoreceptor web to be installed on the roller unit and can be inserted in the main body of the printer to encompass the roller unit. Further, a belt removing cartridge, for removing the photoreceptor web installed on the roller unit, is capable of being inserted in the main body of the printer. Further, the apparatus includes a locking/releasing means for selectively locking to and releasing from the roller unit, the belt installation cartridge or the belt removing cartridge when inserted in the main body of the printer. Moreover, the apparatus includes a recognition means for recognizing the type of the belt cartridge inserted in the main body of the printer.

BRIEF DESCRIPTION OF THE DRAWINGS

The above and other objects and advantages of the present invention will become more apparent by describing in detail a preferred embodiment thereof with reference to the attached drawings in which.

DETAILED DESCRIPTION OF THE INVENTION

Figure 1:
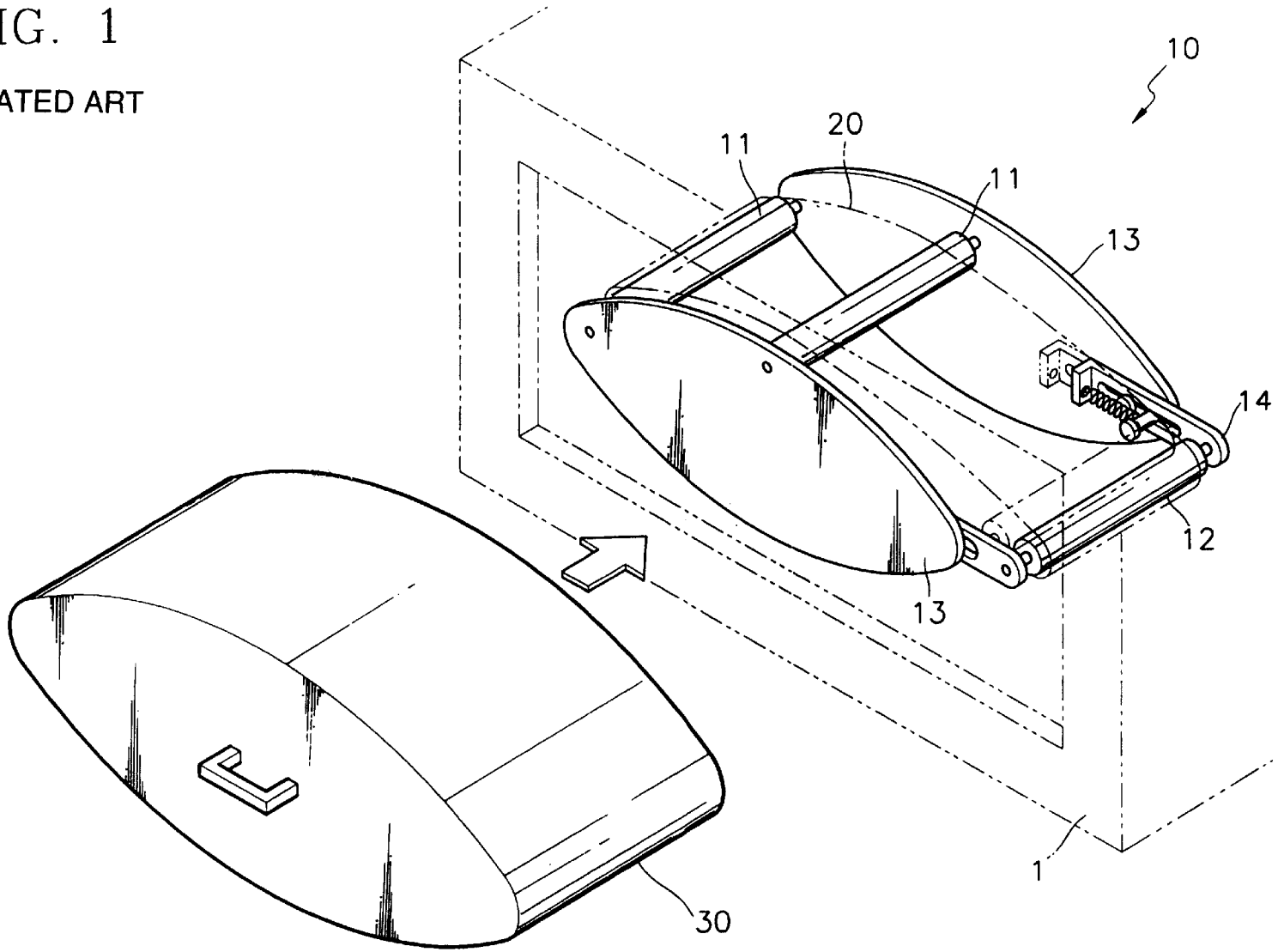
FIG. 1 RELATED ART
FIG. 1 is a perspective view showing a state in which a photoreceptor web is installed on a general roller unit.
Figure 2:
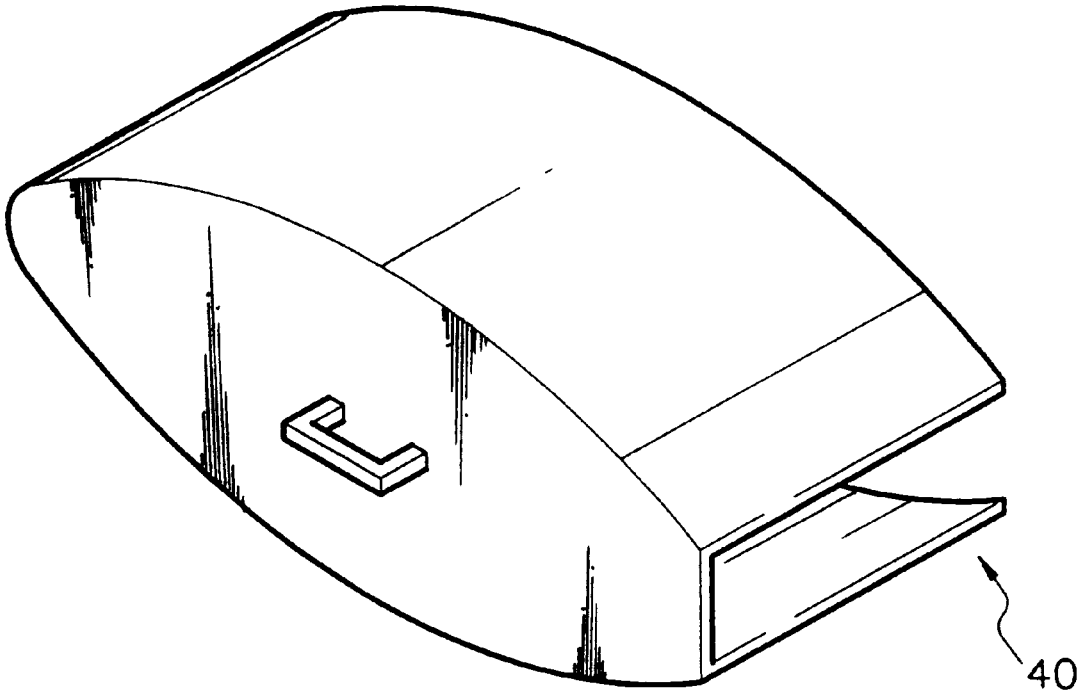
FIG. 2 RELATED ART
FIG. 2 is a perspective view showing a belt removing cartridge for removing the photoreceptor web installed on the roller unit shown in FIG. 1.
Figure 3:
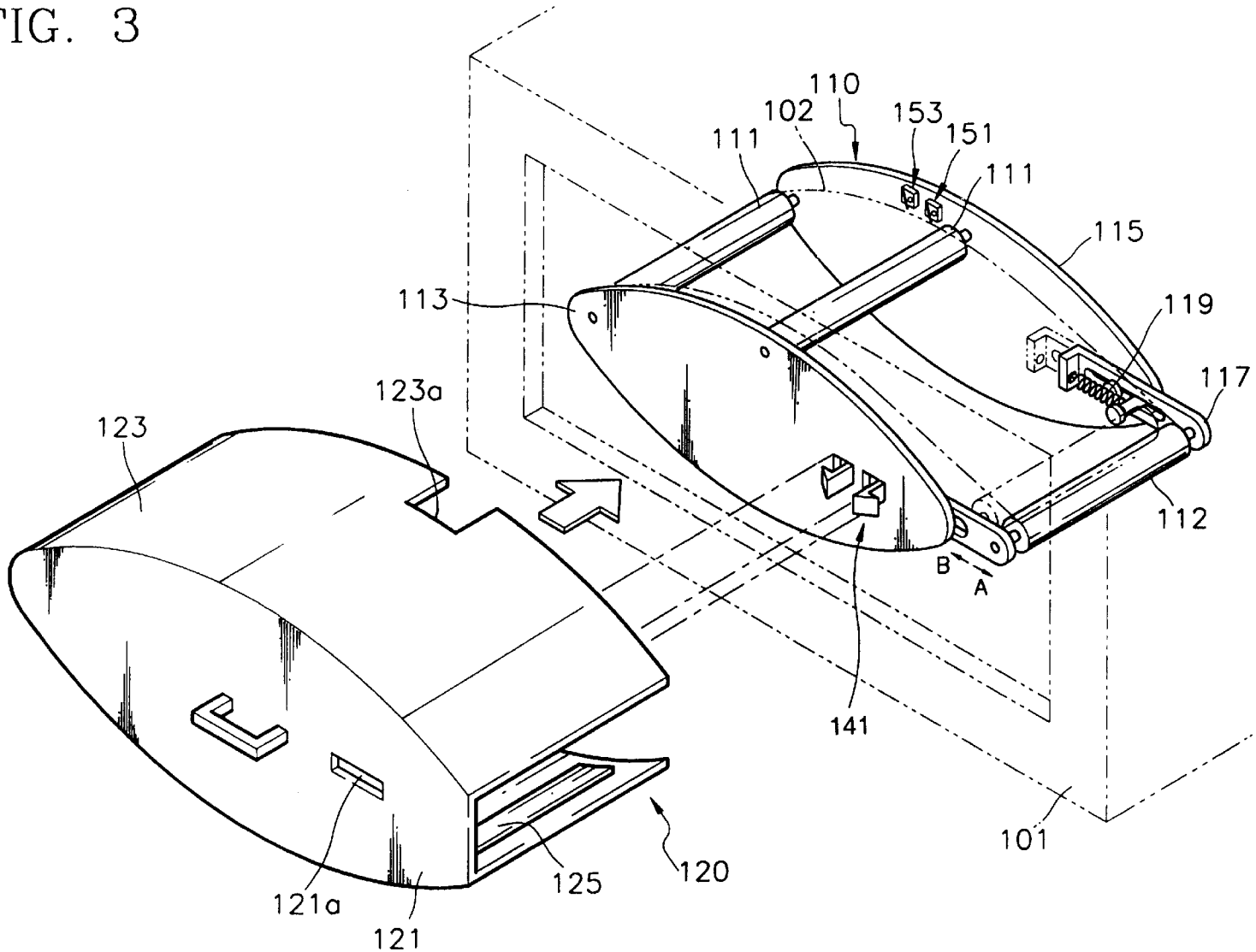
FIG. 3 is a perspective view showing a photoreceptor web installing/removing apparatus of a printer according to a preferred embodiment of the present invention.
Figure 4:
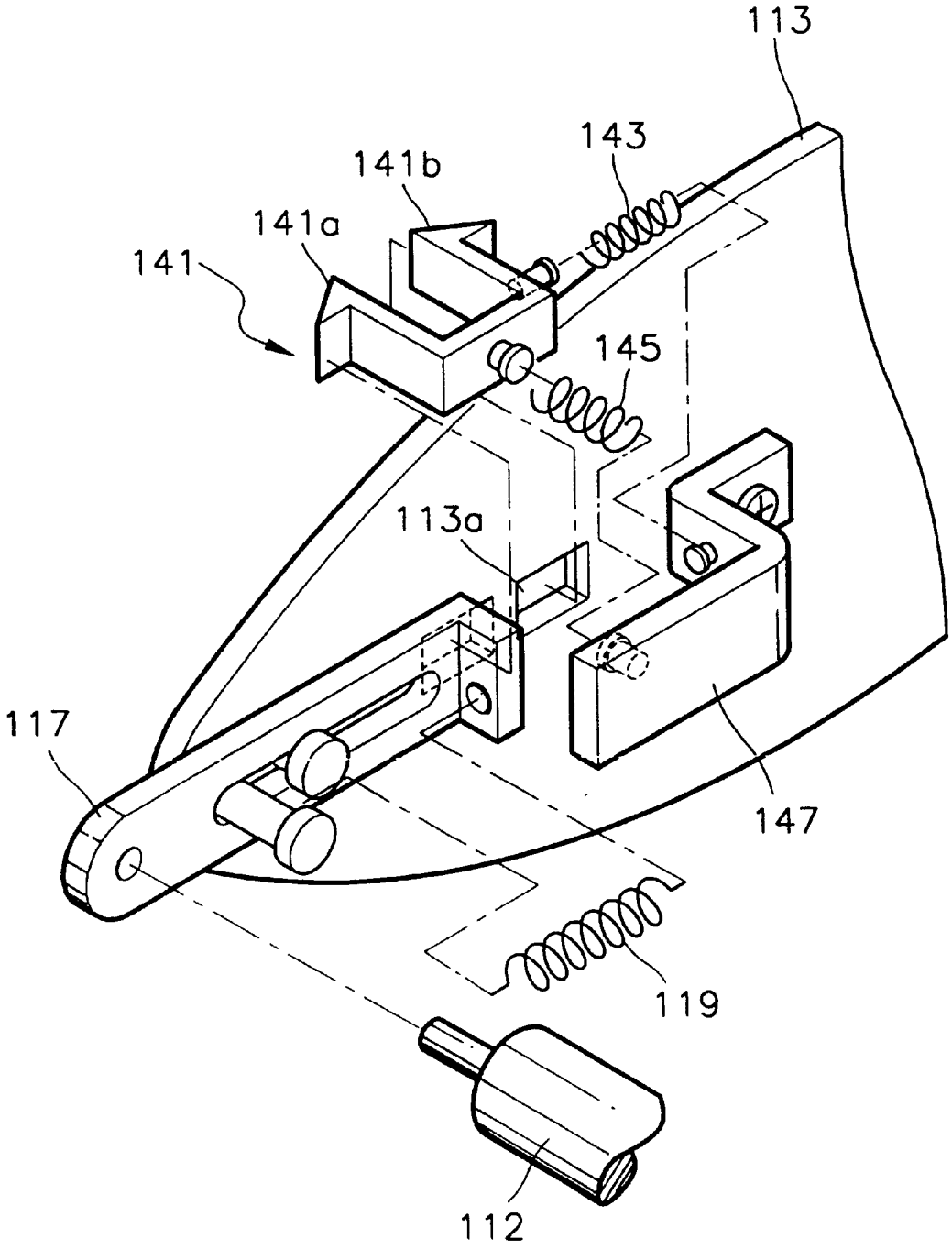
FIG. 4 is an exploded perspective view showing major parts of FIG. 3.
Figure 5:
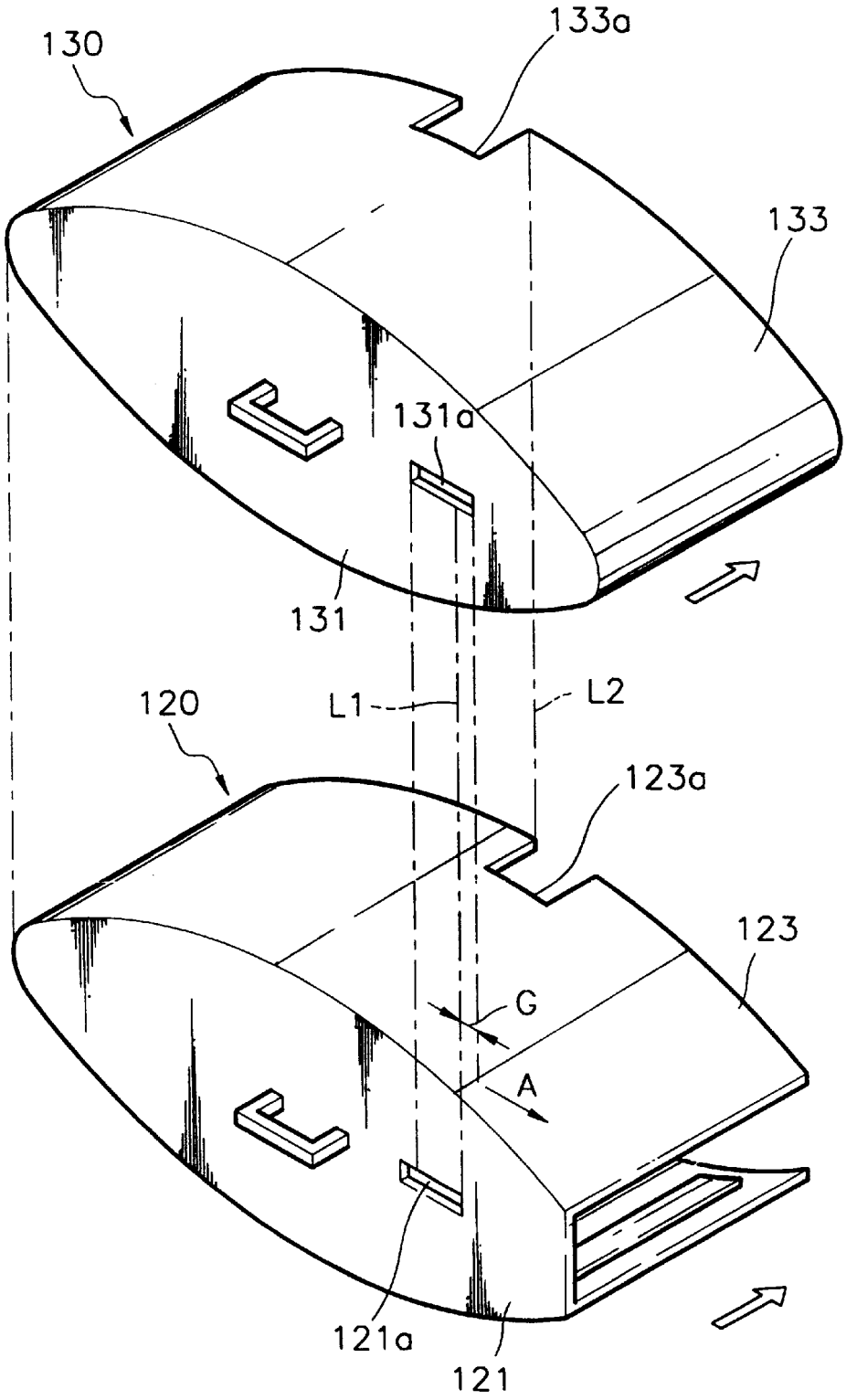
FIG. 5 is a perspective view showing the belt cartridges according to a preferred embodiment of the present invention.

Referring to FIGS. 3 through 5, the photoreceptor web installation/removing apparatus, for a printer, according to a preferred embodiment of the present invention includes a roller unit 110 installed in a main body 101 of the printer and on which a photoreceptor web 102 is installed. A belt removing cartridge 120 is insertable in the main body 101 to remove the photoreceptor web 102 which is installed on the roller unit 110. Additionally, a belt installation cartridge 130 is inserted in the main body 101 to install a new photoreceptor web on the roller unit 110. Further, a locking/releasing device is provided for selectively locking or releasing the belt removing cartridge 120 and the belt installing cartridge 130 when either of the cartridges is inserted in the main body 101. Moreover, a recognition device is provided for recognizing the type of cartridge inserted in the main body 101.

The roller unit 110 includes a plurality of support rollers 111 for supporting the photoreceptor web 102 so as to enable the photoreceptor web 102 to circulate. A front frame 113 and a rear frame 115 support respective ends of the support rollers 111. A pair of mobile brackets 117, movably coupled to each of the frames 113 and 115, supports a tension roller 112 for adjusting the tension of the photoreceptor web 102. The mobile brackets 117 are elastically biased by tension springs 119—coupled to the frames 113 and 115, respectively—toward the first position A to tension the photoreceptor web 102, and are moved toward the second position B by a predetermined driving device (not shown).

The belt removing cartridge 120 is a box-shaped case having a front side-wall 121, an outer circumferential wall 123 connected to the front side-wall 121, and a rear-side wall which is open so that the roller unit 110 can be inserted therein when the belt removing cartridge 120 is inserted in the main body 101 of the printer. Also, a predetermined clamping unit 125, for clamping the photoreceptor web 102 installed on the roller unit 110, is provided in the belt removing cartridge 120. Further, a first locking hole 121*a*, by which a hook member 141 (described later) is locked, is formed in the front-side wall 121. A first groove 123*a* is formed in the outer circumferential wall 123 and is indented toward the front side wall 121.

The belt installation cartridge 130, in which a new photoreceptor web to be installed at the roller unit 110 is accommodated, is a box-shaped case, similar to the belt removing cartridge 120. The belt installation cartridge has a front side-wall 131, an outer circumferential wall 133 connected to the front side-wall 131, and a rear-side wall which is open so that the belt installation cartridge 130 can encompass the roller unit 110 as it is inserted in the main body 101 of the printer. A second locking hole 131*a*, by which the hook member 141 is hooked, is formed in the front side wall 131. The second locking hole 131*a* is formed so as to be offset a predetermined distance G from the first locking hole 121*a* toward the first position A with respect to a reference line L1, as shown in FIG. 5. The second locking hole 131*a* is thus able to be hooked by the hook member 141 when the hook member 141 is positioned to be released from the second locking hole 121*a*. Also, a second groove 133*a* is formed indented toward the front-side wall 131 in the outer circumferential wall 133 and is offset from the first groove 123*a* with respect to a reference line L2 so that the belt installation cartridge 130 can easily be distinguished from the belt removing cartridge 120.

The locking/releasing device includes a hook member 141 installed on the front frame 113 so as to be movable between the first position A where the hook member 141 is locked to the belt removing cartridge 120, and the second position B where the hook member 141 is released from the belt removing cartridge 120 and is positioned to be locked to the belt installation cartridge 130. The hook member 141 is elastically pressed toward the first position A by a first pressing spring 143 and is moved to the second position B by a pushing force from the mobile bracket 117. That is, the hook member 141 penetrates a slit 113*a* formed in the front frame 113 and slides between the first position A and the second position B. For this purpose, the hook member 141 includes a first elastic hook 141*a* for locking to the first locking hole 121*a*, and a second elastic hook 141*b* formed a predetermined distance from the first elastic hook 141*a* and for locking to the second locking hole 131*a*.

Also, the locking/releasing device further includes a second pressing spring 145 elastically pressing the hook member 141 toward the front side of the front frame 113. A support member 147, installed on the front frame 113, supports the first pressing spring 143 and the second pressing spring 145.

The recognition device includes a first switch 151 and a second switch 153 installed at positions which are separated a predetermined distance, and positions which correspond to an open end portion of each belt cartridge 120 and 130, respectively. The switches 151 and 153 are installed on the rear frame 115.

The first switch 151, installed at the position corresponding to the first groove 123*a* of the belt removing cartridge 120 so as to recognize the belt installation cartridge 130, is switched by being pressed by an open end portion of the belt installation cartridge 130 when inserted in the main body 101 of the printer. The second switch 153, installed at a position corresponding to the second groove 133*a* of the belt installation cartridge 130 so as to recognize the belt removing cartridge 120, is switched by being pressed by an open end portion of the belt installation cartridge 130 inserted in the main body 101 of the printer.

Figure 6:
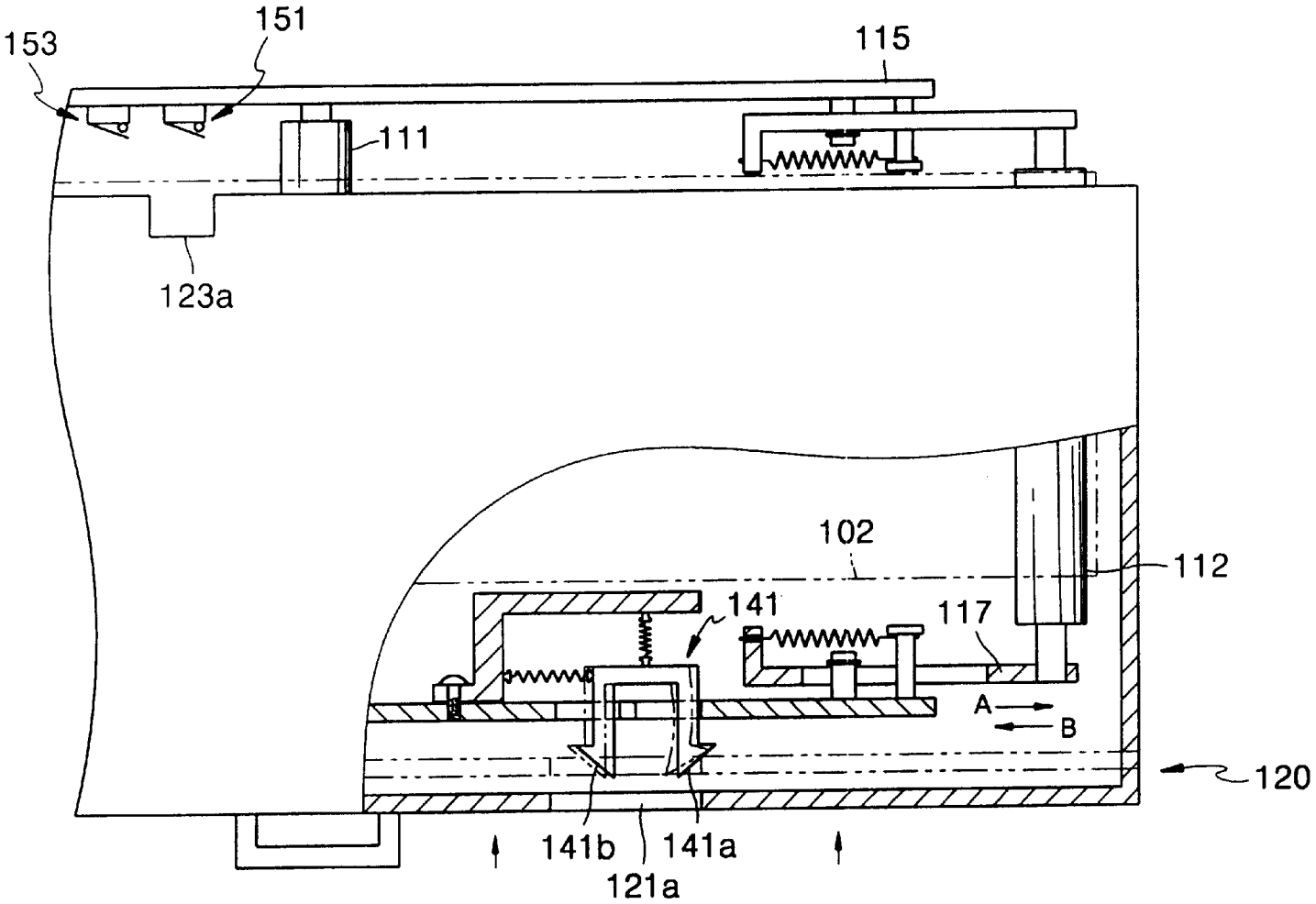
FIG. 6 is a partially cut-away plan view showing a state before the belt removing cartridge of FIG. 3 is installed on the roller unit.

The operation of the belt installation/removing apparatus according to the preferred embodiment of the present invention, having the above structure, will now be described. First, the photoreceptor web 102 installed at the roller unit 110 is removed. As shown in FIG. 6, the photoreceptor web 102 is tensioned by the mobile bracket 117 which is moved to the first position A. While the hook member 141 is located at the first position A, the belt removing cartridge 120 is gradually inserted in the main body 101 of the printer such that the first groove 123*a* corresponds to the first switch 151.

Figure 7:
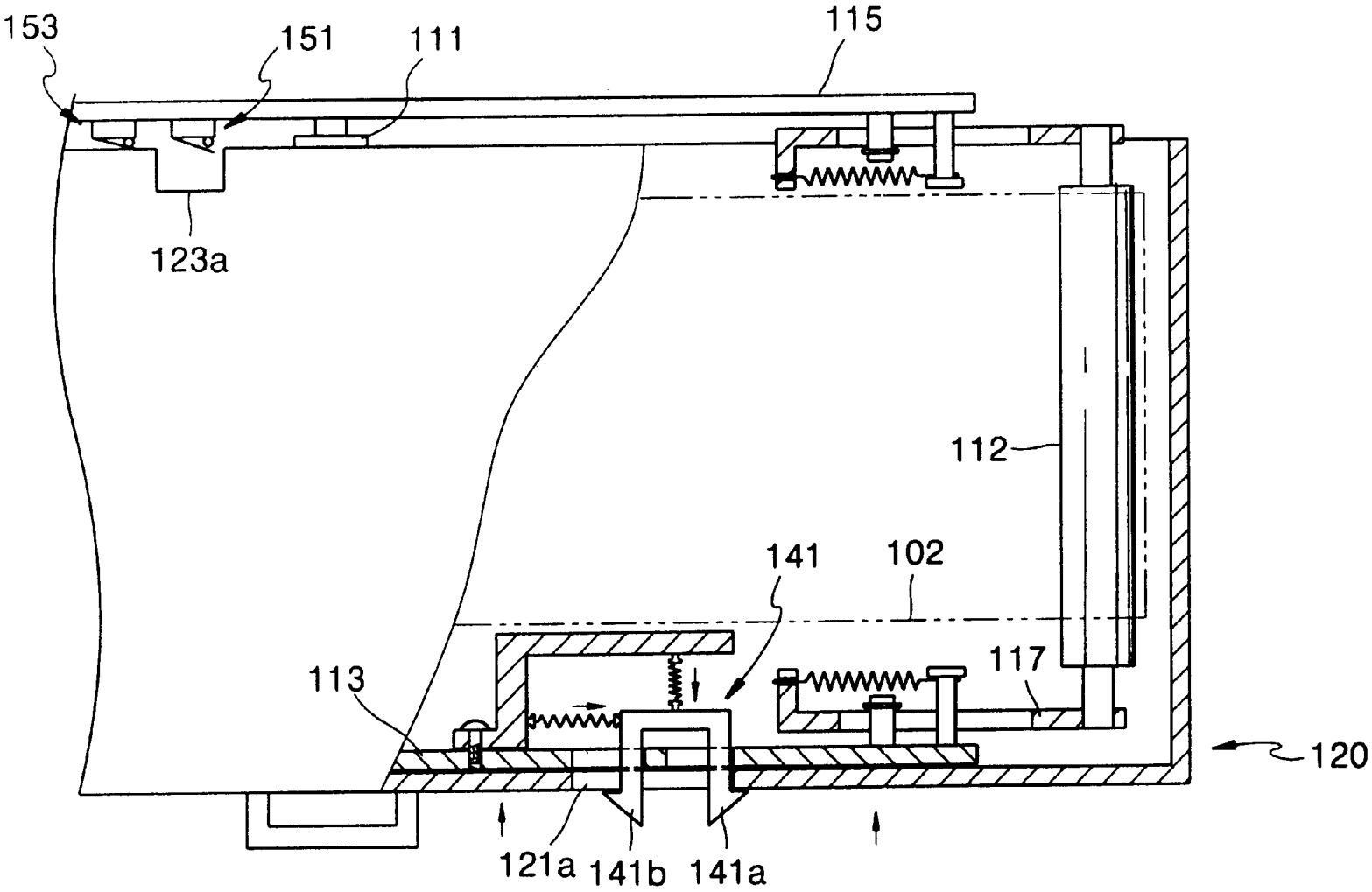
FIG. 7 is a partially cut-away plan view showing a state in which the belt removing cartridge of FIG. 3 is locked to the roller unit.

When the belt removing cartridge 120 is inserted to some degree, the first elastic hook 141*a* is pressed by the edge of the first locking hole 121*a* and is elastically deformed. As the belt removing cartridge 120 is further inserted, as shown in FIG. 7, the first elastic hook 141*a* passes through the first locking hole 121*a* and is elastically restored so as to be locked to the first locking hole 121*a*. Thus, the belt removing cartridge 120 is completely inserted in the main body 101 of the printer and is fixedly disposed, so that a user does not have to directly check the installation of the photoreceptor web 102.

Figure 8:
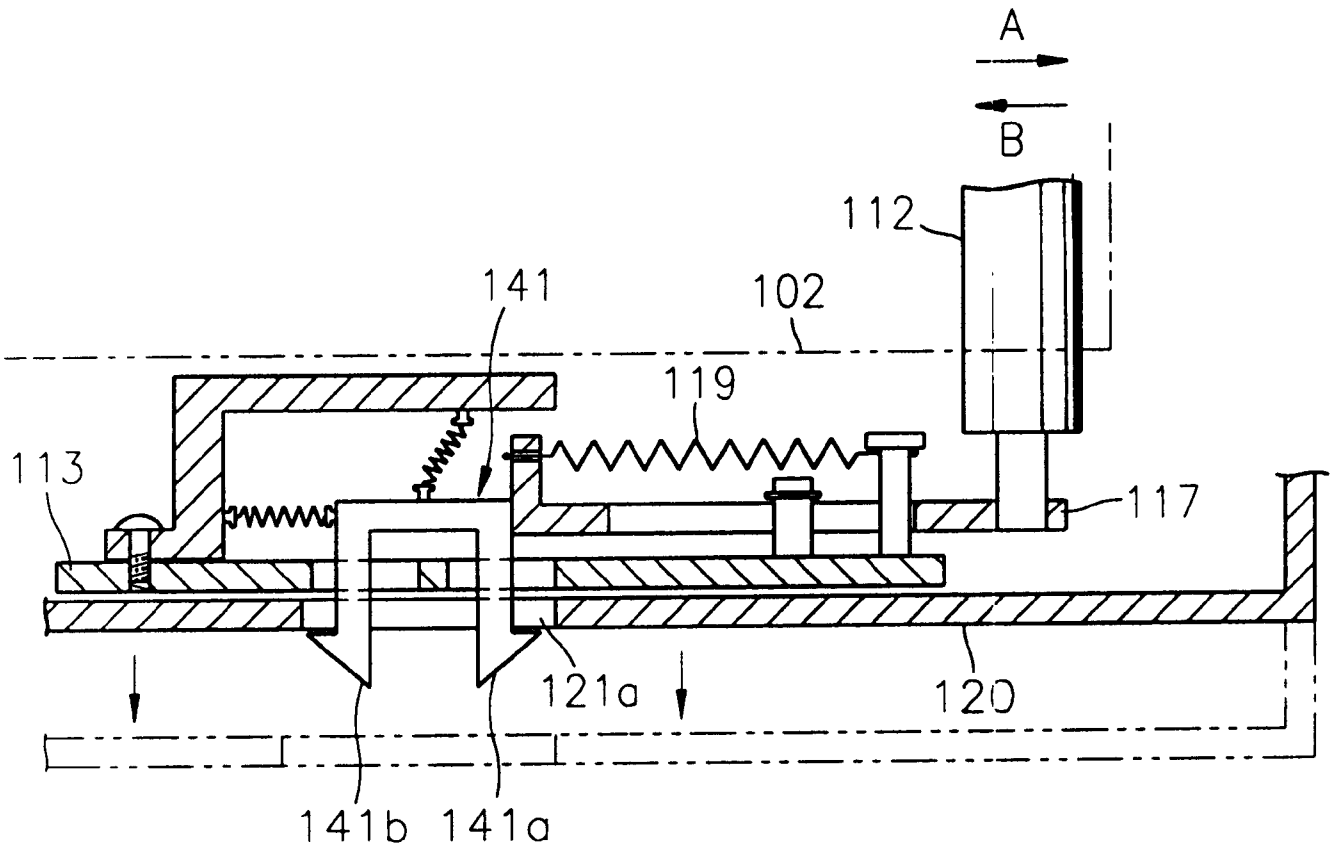
FIG. 8 is a sectional view showing a state in which locking of the belt removing cartridge to the roller unit is released.

When the belt removing cartridge 120 is fixedly installed, the first switch 151 is accommodated in the first groove 123*a* and the second switch 151 is depressed by the open end portion of the belt removing cartridge 120. Thus, the installed state of the belt removing cartridge 120 is recognized. When it is recognized that the belt removing cartridge 120 is inserted in the main body 101, as shown in FIG. 8, the mobile bracket 117 is moved toward the second position B by using the driving device to lessen the tension of the photoreceptor web 102. Then, the hook member 141 is pushed to the second position B by the mobile bracket 117. Thus, the first elastic hook 141*a* is released from the first locking hole 121*a*. Then, the photoreceptor web 102 is free from the roller unit 110 and is clamped by the clamping device 125 in the belt removing cartridge 120 so as to be confined by the belt removing cartridge 120. Hence, when the belt removing cartridge 120 is moved as indicated by an imaginary line, the photoreceptor web 102 is removed from the roller unit 110.

Figure 9:
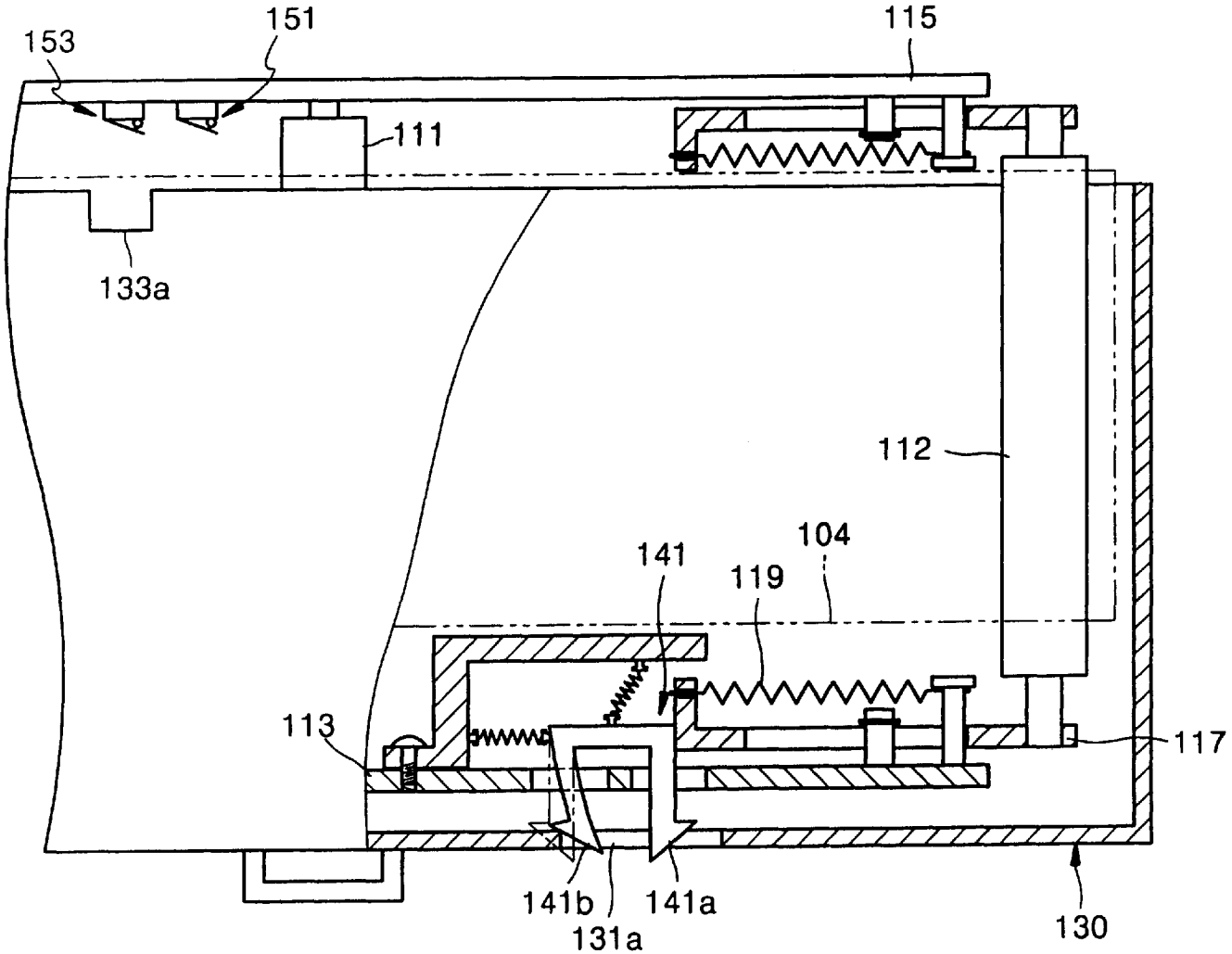
FIG. 9 is a partially cut-away plan view showing a state before the belt installation cartridge of FIG. 5 is locked to the roller unit.

Next, a new photoreceptor web 104 is installed on the roller unit 110, as shown in FIG. 9. To install the new photoreceptor web 104, when the hook member 141 is pushed by the mobile bracket 117 to the second position B, the belt installation cartridge 130 accommodating the new photoreceptor web 104 is gradually inserted into the main body 101 of the printer such that the second groove 133*a* corresponds to the second switch 153.

Figure 10:
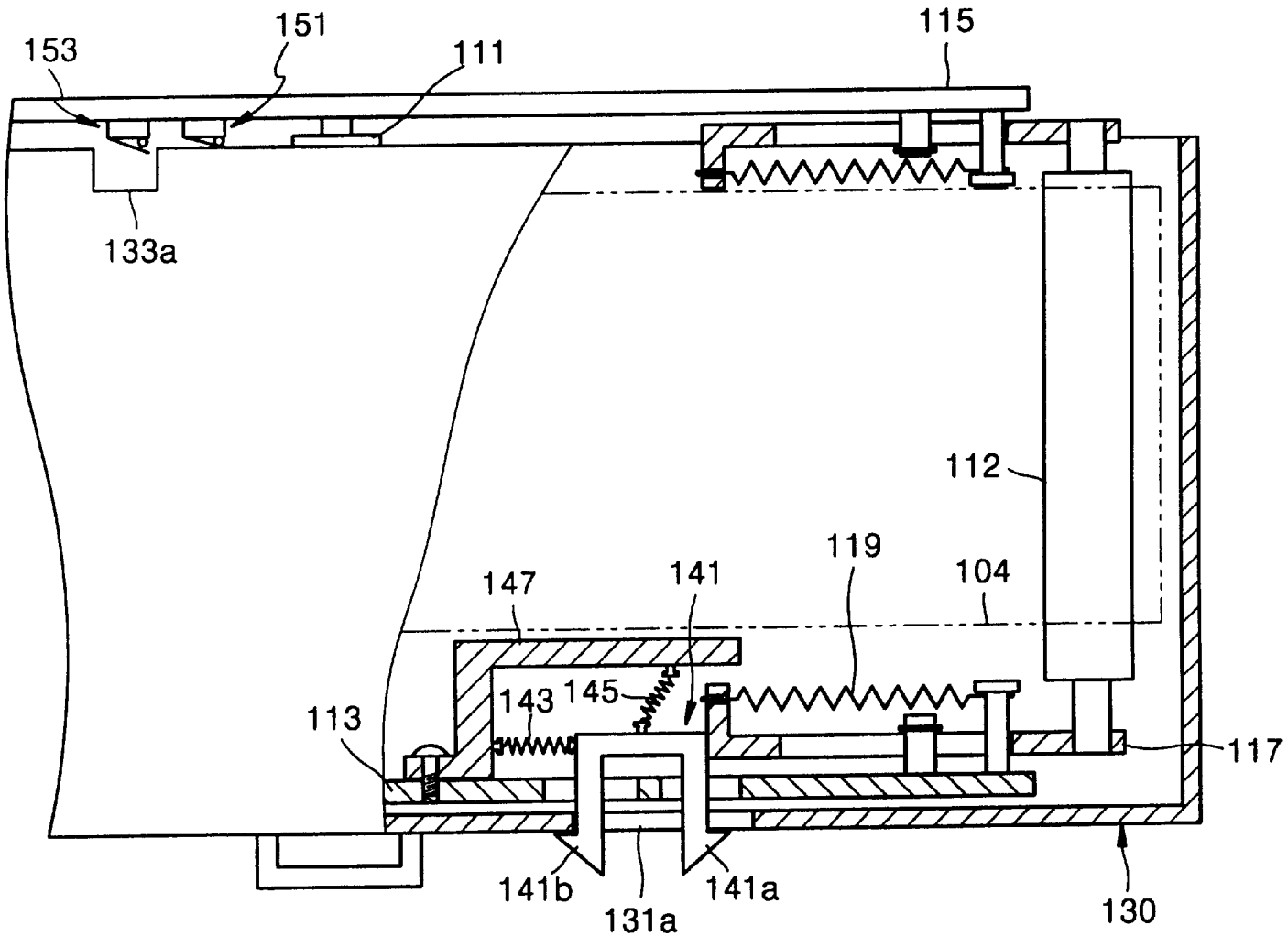
FIG. 10 is a partially cut-away plan view showing a state in which the belt installation cartridge of FIG. 5 is locked to the roller unit.
Figure 11:
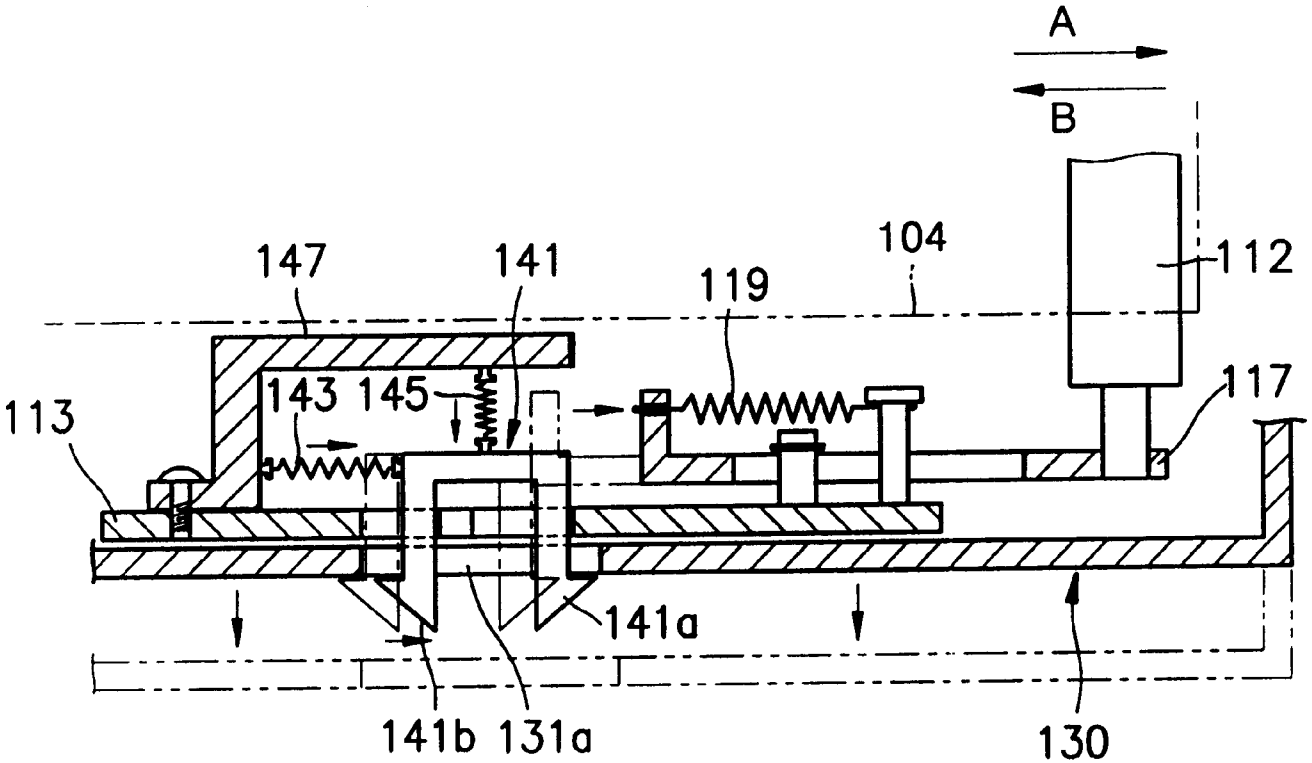
FIG. 11 is a sectional view showing a state in which locking of the belt installation cartridge to the roller unit is released.

When the belt installation cartridge 130 is inserted a certain distance, the second elastic hook 141*b* is pressed by the edge portion of the second locking hole 131*a* and is elastically deformed. As the belt installation cartridge 130 is further inserted, the second elastic hook 141*b* passes through the second locking hole 131*a* and then is elastically restored. As shown in FIG. 10, the second elastic hook 141*b* is thus locked to the second locking hole 131*a* so that the belt installation cartridge 130 is fixed on the main body 101 of the printer. The first switch 151 is pressed, and thus switched, by the open end portion of the belt installation cartridge 130 so that the insertion of the belt installation cartridge 130 is recognized. When the driving device is driven according to the recognition information, the mobile bracket 117 is moved to the first position A and the new photoreceptor web 104 is tensioned. Thus, the photoreceptor web 104 is supported by the support rollers 111 and the tension roller 112, and is confined by the roller unit 110. While being separated from the mobile bracket 117, the hook member 141 returns to the first position A by a pressing force of the first pressing spring 145 so that the second elastic hook 141*b* is released from the second locking hole 131*a*. In this state, as shown in FIG. 11, when the belt installation cartridge 130 is moved to the position indicated by an imaginary line out of the main body 101 of the printer, the new photoreceptor web 104 is separated from the belt installation cartridge 130 and remains in the roller unit 110.

As described above, in the photoreceptor web installation/releasing apparatus according to the preferred embodiment of the present invention, the type of belt cartridges 120 and 130 inserted in the main body 101 of the printer is recognized and the two belt cartridges 120 and 130 can be selectively locked in the main body of the printer. Thus, the installation state of the belt cartridge need not be checked each time. Also, the belt cartridges 120 and 130 are prevented from being incorrectly installed on the roller unit 110.

It is contemplated that numerous modifications may be made to the photoreceptor web installation/releasing apparatus of the present invention without departing from the spirit and scope of the invention as defined in the following claims.

What is claimed is:

1. A photoreceptor web installation/removing apparatus, for a printer, comprising:

a roller unit installed in a main body of the printer and having:

a support roller for supporting a photoreceptor web;

a frame for supporting both ends of said support roller;

a tension roller; and a pair of mobile brackets, movably installed on said frame, for supporting both ends of said tension roller;

a belt installation cartridge accommodating a new photoreceptor web adapted to be installed on said roller unit and to be inserted in the main body of the printer so as to encompass said roller unit;

a belt removing cartridge for removing the photoreceptor web installed on said roller unit, wherein said belt removing cartridge is capable of being inserted in the main body of the printer so as to encompass said roller unit;

a locking/releasing means for selectively locking to and releasing from said roller unit, said belt installation cartridge and said belt removing cartridge when inserted in the main body of the printer; and a recognition means for recognizing the type of belt cartridge inserted in the main body of the printer.

2. The apparatus as claimed in claim 1, wherein said locking/releasing means comprises:

a hook member installed on said frame so as to be movable between a first position where said hook member is positioned to be locked to said belt removing cartridge when inserted in the main body of the printer, and a second position where said hook member is released from said belt removing cartridge and is positioned to be locked to said belt installation cartridge, wherein said mobile bracket is positioned to push said hook member toward said second position;

a first pressing spring for elastically pressing said hook member toward said first position;

a first locking hole formed on a front side-wall of said belt removing cartridge facing said hook member, to which said hook member can be locked; and a second locking hole formed on a front-side wall of said belt installing cartridge facing said hook member, to which said hook member can be locked.

3. The apparatus as claimed in claim 2, wherein said hook member comprises:

a first elastic hook to be locked to said first locking hole; and a second elastic hook formed a predetermined distance from said first elastic hook so as to be locked to said second locking hole.

4. The apparatus as claimed in claim 2, wherein said locking/releasing means further comprises a second pressing spring for elastically pressing said hook member in a direction opposite to that in which the belt installation cartridge and the belt removing cartridge are inserted into the main body.

5. The apparatus as claimed in claim 4, wherein said locking/releasing means further comprises a support member installed on said frame for supporting said first pressing spring and said second pressing spring.

6. The apparatus as claimed in claim 5, wherein said locking/releasing means further comprises a slit formed in said frame so that said hook member is movably received in said slit.

7. The apparatus as claimed in claim 1, wherein said recognition means comprises:

a first switch and a second switch installed on said frame so as to correspond to an open end portion of each belt cartridge, said first switch being pressed and switched by said belt installation cartridge inserted in the main body of the printer, and said second switch being pressed and switched by said belt removing cartridge inserted in the main body of the printer;

a first groove formed inwardly in the open end portion of said belt removing cartridge, such that, when said belt removing cartridge is inserted in the main body of the printer, said first switch is not switched; and a second groove formed inwardly in the open end portion of said belt installation cartridge, such that, when said belt installation cartridge is inserted in the main body of the printer, said second switch is not switched.

8. A photoreceptor web installation/removing apparatus, for a printer, comprising:

a roller unit installed in a main body of the printer and having:

a support roller for supporting a photoreceptor web;

a frame for supporting both ends of said support roller;

a tension roller; and a pair of mobile brackets, movably installed on said frame, for supporting both ends of said tension roller;

a belt installation cartridge accommodating a new photoreceptor web adapted to be installed on said roller unit and to be inserted in the main body of the printer so as to encompass said roller unit;

a belt removing cartridge for removing the photoreceptor web installed on said roller unit, wherein said belt removing cartridge is capable of being inserted in the main body of the printer so as to encompass said roller unit;

a lock which selectively locks said belt installation cartridge and said belt removing cartridge to said roller unit when inserted in the main body of the printer; and a recognition device which recognizes the type of belt cartridge inserted in the main body of the printer.

9. The apparatus as claimed in claim 8, wherein said lock comprises:

a hook member installed on said frame so as to be movable between a first position where said hook member is positioned to be locked to said belt removing cartridge when inserted in the main body of the printer, and a second position where said hook member is released from said belt removing cartridge and is positioned to be locked to said belt installation cartridge, wherein said mobile bracket is positioned to push said hook member toward said second position;

a first pressing spring for elastically pressing said hook member toward said first position;

a first locking hole formed on a front side-wall of said belt removing cartridge facing said hook member, to which said hook member can be locked; and a second locking hole formed on a front-side wall of said belt installing cartridge facing said hook member, to which said hook member can be locked.

10. The apparatus as claimed in claim 9, wherein said hook member comprises:

a first elastic hook to be locked to said first locking hole; and a second elastic hook formed a predetermined distance from said first elastic hook so as to be locked to said second locking hole.

11. The apparatus as claimed in claim 9, wherein said lock further comprises a second pressing spring for elastically pressing said hook member in a direction opposite to that in which the belt installation cartridge and the belt removing cartridge are inserted into the main body.

12. The apparatus as claimed in claim 11, wherein said lock further comprises a support member installed on said frame for supporting said first pressing spring and said second pressing spring.

13. The apparatus as claimed in claim 12, wherein said lock further comprises a slit formed in said frame so that said hook member is movably received in said slit.

14. The apparatus as claimed in claim 8, wherein said recognition device comprises:

a first switch and a second switch installed on said frame so as to correspond to an open end portion of each belt cartridge, said first switch being pressed and switched by said belt installation cartridge inserted in the main body of the printer, and said second switch being pressed and switched by said belt removing cartridge inserted in the main body of the printer;

a first groove formed inwardly in the open end portion of said belt removing cartridge, such that, when said belt removing cartridge is inserted in the main body of the printer, said first switch is not switched; and a second groove formed inwardly in the open end portion of said belt installation cartridge, such that, when said belt installation cartridge is inserted in the main body of the printer, said second switch is not switched.

* * * * *